US012083592B2

(12) United States Patent
Barker et al.

(10) Patent No.: US 12,083,592 B2
(45) Date of Patent: Sep. 10, 2024

(54) SHAPED CHARGE LINER WITH NANOPARTICLES

(71) Applicant: Halliburton Energy Services, Inc., Houston, TX (US)

(72) Inventors: James Marshall Barker, Mansfield, TX (US); Corbin Sean Glenn, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 398 days.

(21) Appl. No.: 17/031,437

(22) Filed: Sep. 24, 2020

(65) Prior Publication Data

US 2021/0207932 A1 Jul. 8, 2021

Related U.S. Application Data

(63) Continuation of application No. 14/768,280, filed as application No. PCT/US2013/043747 on May 31, 2013, now abandoned.

(51) Int. Cl.
*E21B 43/117* (2006.01)
*B22F 1/00* (2022.01)
(Continued)

(52) U.S. Cl.
CPC ..... *B22F 1/09* (2022.01); *B22F 1/054* (2022.01); *B22F 1/10* (2022.01); *B22F 3/02* (2013.01);
(Continued)

(58) Field of Classification Search
CPC ..... F42B 1/032; F42B 1/036; B22F 1/0003; B22F 1/0059; B22F 3/02; B22F 2999/00; C22C 1/045; C22C 27/04; E21B 43/117
See application file for complete search history.

(56) References Cited

U.S. PATENT DOCUMENTS 4,932,239 A * 6/1990 Regalbuto ..... F42B 35/00 73/12.08
7,811,354 B2 10/2010 Leidel et al.
(Continued)

FOREIGN PATENT DOCUMENTS

| | | |
|---|---|---|
| GB | 2476993 B | 2/2015 |
| WO | 2004048880 A1 | 6/2004 |
| WO | 2005035939 A1 | 4/2005 |

OTHER PUBLICATIONS

Kardani, A., Montazeri, A., Metal-Matrix Nanocomposites Under Compressive Loading: Towards an understanding of how twinning formation can enhance their plastic deformation, Jun. 16, 2020, https://doi.org/10.1038/s41598-020-66696-1, 10, 9745 (2020), Scientific Reports.

(Continued)

*Primary Examiner* — Taras P Bemko
(74) *Attorney, Agent, or Firm* — K&L Gates LLP

(57) ABSTRACT

A liner (18) for a shaped-charge (10) that is compressively formed from a mixture of powdered metal, powdered metal binder, and a selected quantity of nanoparticle material, is used to achieve improved penetration depths during perforation of a wellbore. Exemplary nanoparticles include lead, tin, copper, molybdenum, etc. Such nanoparticles increase the density, sound speed, or acoustic impedance of the liner. In another embodiment, the added nanoparticles comprise reactive materials which, after penetration into the formation, cause secondary reactions in the perforations.

25 Claims, 3 Drawing Sheets

(51) Int. Cl.

| | |
|---|---|
| ***B22F 1/054*** | (2022.01) |
| ***B22F 1/10*** | (2022.01) |
| ***B22F 3/02*** | (2006.01) |
| ***C22C 1/04*** | (2023.01) |
| ***C22C 27/04*** | (2006.01) |
| ***F42B 1/032*** | (2006.01) |
| ***F42B 1/036*** | (2006.01) |

(52) U.S. Cl.
CPC ..... *C22C 1/045* (2013.01); *C22C 27/04* (2013.01); *E21B 43/117* (2013.01); *F42B 1/032* (2013.01); *F42B 1/036* (2013.01); *B22F 2999/00* (2013.01)

(56) References Cited

U.S. PATENT DOCUMENTS

| | | | | |
|---|---|---|---|---|
| 8,657,974 | B1 * | 2/2014 | Mayville | C06C 9/00 149/2 |
| 2002/0129726 | A1 | 9/2002 | Clark et al. | |
| 2005/0115448 | A1 | 6/2005 | Pratt et al. | |
| 2006/0115448 | A1 | 6/2006 | Tew | |
| 2007/0056462 | A1 * | 3/2007 | Bates | F42B 1/032 102/476 |
| 2009/0151949 | A1 | 6/2009 | Marya et al. | |
| 2010/0154670 | A1 | 6/2010 | Leidel et al. | |
| 2010/0210450 | A1 | 8/2010 | Yadav | |
| 2011/0094406 | A1 | 4/2011 | Marya et al. | |
| 2012/0085585 | A1 | 4/2012 | Scott et al. | |
| 2012/0100373 | A1 * | 4/2012 | Shinbach | C09C 1/56 428/402 |
| 2013/0056208 | A1 | 3/2013 | Xu | |
| 2013/0337414 | A1 * | 12/2013 | Li | A61K 6/17 433/224 |
| 2015/0115193 | A1 * | 4/2015 | Kim | H01F 1/0054 252/62.55 |
| 2015/0250829 | A1 * | 9/2015 | Daniel | A61L 27/36 424/489 |

OTHER PUBLICATIONS

Zhai, Wengang; Zhou, Wei; Mui Ling Nai, Sharon & Wei, Jun, Characterization of nanoparticle mixed 316L powder for additive manufacturing, Feb. 22, 2020, pp. 162-168, 47 (2020), Journal of Materials Science & Technology (www.jmst.org).

Onbattuvelli, Valmikanathan P. [et al.]: The effects of nanoparticle addition on SiC and AIN powder-polymer mixtures: packing and flow behavior. In: International journal of refractory metals and hard materials, vol. 36, 2013, S. 183-1 90.-ISSN 0263-4368.

International Search Report dated Feb. 26, 2014, issued in PCT application No. PCT/US2013/043747, 18 pages.

Kocjan, Andraž et al., "The agglomeration, coalescence and sliding of nanoparticles, leading to the rapid sintering of zirconia nanoceramics" (2017) pp. 1-8, Scientific Reports.

* cited by examiner

SHAPED CHARGE LINER WITH NANOPARTICLES

CROSS REFERENCE TO RELATED APPLICATIONS

None.

BACKGROUND

Technical Field

Liner materials for use in manufacturing shaped charges that are used in various applications, including without limitation, hydrocarbon production, building demolition, and other applications.

Background

In hydrocarbon production, shaped charges are used to make hydraulic communication passages, called perforations, in a wellbore drilled into the earth. The perforations are needed as wellbore casing is typically cemented in place with the wellbore. The cemented casing hydraulically isolates the various formations penetrated by the wellbore.

Shaped charges typically include a housing, a quantity of high explosives and a liner. The liner may have different geometrical shapes such as hemispheres, discs, and cones. One of the more common shapes is generally conical and is formed by compressing powdered metal. The major constituents of the powdered metal for deep penetrating charges are typically copper and tungsten, with lesser amounts of malleable materials such as lead or tantalum to serve as a binder.

Attempts have been made to improve liner designs and penetration depths by using blends of powdered metals to form the liners, the powdered metals having a higher density than traditional copper/tungsten liners, but even greater penetration depths beyond that achieved by the above-described are still desirable. Approaches to increasing the density of a liner have included processes to squeeze out voids therein using higher pressing forces and by using repeated pressing steps with annealing between steps. However, these approaches can result in crushing of particles and work-hardening which leaves undesirable metallurgical outcomes.

Therefore, a need has arisen for a shaped charge that yields improved penetration depths when used for perforating a wellbore. A need has also arisen for such a shaped charge having a liner comprising powdered material mixtures with higher density and/or higher acoustic impedance to achieve improved penetration depths.

SUMMARY OF THE INVENTIONS

The present invention further comprises liner mixtures made by adding substantial quantities of nano-size particles that exhibit ductility or promote ductility to prevent cracking of the liner during pressing. These materials at the nanoparticle level include tungsten, copper, tantalum, bismuth, lead, and nickel. Mixtures of nanoparticle materials can be used as well.

The present invention further comprises liner mixtures made by adding nano-size particles that have reactive qualities to produce a secondary reaction in the perforation tunnel. These materials include aluminum, zinc, magnesium, niobium, zirconium, and titanium.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION

Figure 1:
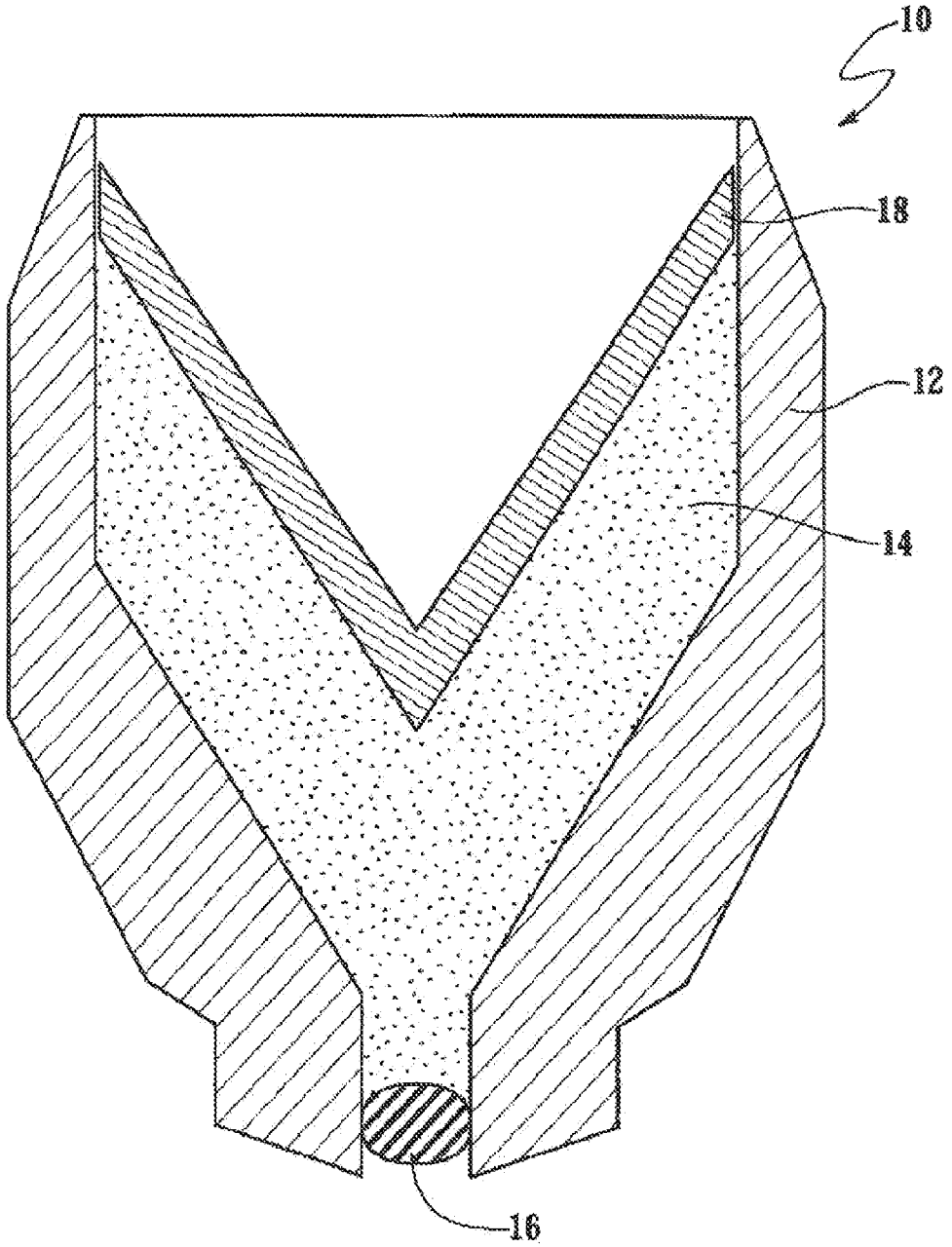
FIG. 1 is a cross section view of a shaped-charge used in well bore perforation operations.

Shaped charges typically include a housing, a quantity of high explosives and a liner. The liner may have different geometrical shapes such as hemispheres, discs, and cones. One of the more common shapes is generally conical, and is formed by compressing powdered metal. The major constituents of the powdered metal for deep penetrating charges are typically copper and tungsten, with lesser amounts of malleable materials such as lead or tantalum to serve as a binder.

In operation, the perforation is made by detonating the explosive material which causes the liner to collapse. The collapsing liner ejects a jet of hot metal from the shaped charge at very high velocity. The jet is preferably in a plasmatic state. The jet is able to penetrate the casing (if present), the cement (if present), and the formation, thereby forming a perforation.

The penetration depth of the perforation into the formation is highly dependent upon the design of the shaped charge, and especially those characteristics associated with the liner. The physics of penetration mechanics show that liner density is an important parameter and generally the denser the liner, the greater the perforation performance of a shaped charge. The production rate of fluids through such perforations is determined by the diameter of the perforations and the penetration depth of the perforations. The production rate increases as either the diameter or the penetration depth of the perforations increase. The penetration depth of the perforations is dependent upon, among other things, the material properties of liner. Based upon the physics of penetration mechanics and supporting test data, it has been determined that penetration depth is also dependent upon the sound speed the metal mixture of liner. Consequently, it is the acoustic impedance (the product of the density and the sound speed) of the metal mixture of the liner which determines the penetration depth of perforations. Thus, to optimize the penetration depth, the acoustic impedance and the density of the liner materials should be taken into consideration.

Approaches to increasing the density of a liner, have included processes to squeeze out the voids by using higher pressing forces and by using repeated pressing steps with annealing between steps. However, when these approaches are used, crushing of particles and work hardening may result which leaves undesirable metallurgical outcomes.

Attempts have been made to improve liner designs by using blends of powdered metals having a higher density than the traditional copper/tungsten liner. For example, attempts have been made to design a liner using a mixture of powdered graphite, tungsten, copper, lead, nickel, aluminum, tantalum, and molybdenum. This mixture yields a higher penetration depth than typical copper-lead liners. See, for example, the powdered liner material mixtures described in the U.S. Pat. No. 7,811,354 owned by Halliburton Energy Services, Inc., which is incorporated herein in its entirety by reference for all purposes.

These powdered metals are available in different particle sizes, generally in sizes above 5 microns, and they are blended together to yield tailored mixtures having specified particle-size distributions in the micron range. As used herein, the term "powdered" (and its derivatives) with respect to a material, such as metal or binder metal, or material size means the particles are larger than nanoparticles and are generally sized at or above 5 microns (5000 nanometers (nm)). Similarly, the term "bulk particle" or similar may be used to indicate particles of this size range.

As used herein, unless context otherwise requires, a "particle" refers to a body having a finite mass and sufficient cohesion such that it can be considered as an entity but having relatively small dimensions. A particle can be of any size ranging from molecular scale to macroscopic, depending on context.

The term "nanoparticle" or "nano-sized particles" (or derivatives) as used herein means particles having a one or more dimensions on the order of about 1-2000 nanometers (nm). Sometimes such particles are referred to as ultrafine particles or fine particles. These particles are selected to fit in the voids between the bulk particles or powdered particles. The properties of some conventional materials change when in nanoparticulate form as compared to bulk particulates.

When using such micron-range materials to form a liner, voids or void space remains after formation, causing the overall density of the liner to be lower than the theoretical density of any of the materials in the mixture. For example, a typical pressed liner for a high performance shaped charge will typically have an overall density in the range of about 13.6-14.2 g/cc, but the theoretical density is actually closer to 16.2 g/cc.

In theory, the void space in the above exemplary liner above is "missing" or could contain an additional 2.0-2.6 g/cc of material of similar density. If the void space was filled with nanoparticles of the same density as the liner, a bulk density increase of 1 to about 20 percent (theoretically) could be achieved in this particular example. In this example, for a given liner size (volume), the addition of nanoparticles can increase the weight of the liner by up to about 20%, with the nanoparticles comprising up to about 20 wt % of the liner. This is only one example based on a typical charge liner. Those of skill in the art will recognize that different liner materials with differing constituent particles will provide differing potential ranges of nanoparticulate (by weight, by volume, etc.) which can be employed.

The present invention disclosed herein comprises liner material mixtures for shaped-charge liners that are made by adding substantial quantities of nanoparticles to fill the voids which would otherwise occur in conventional mixtures of powdered materials and create liners with higher densities and/or higher acoustic impedance.

The present invention provides an improved shaped charge apparatus. The present invention comprises liners formed from mixtures of materials which include nano-sized particles, or nanoparticles. Referring more particularly to the drawings, wherein like reference characters are used throughout the various figures to refer to like or corresponding parts, there is shown in FIG. 1 a cross section of a shaped-charge 10 used in well bore perforation made according to the present invention. Shaped-charge 10 has a generally cylindrically shaped housing 12. Housing 12 may be formed from steel or other suitable material. A quantity of high explosive powder 14 is disposed within housing 12. High explosive powder 14 may be selected from many that are known in the art for use in shaped charges such as the following, which are sold under trade designations, such as, HMX, HNS, RDX, and PYX. In the illustrated embodiment, high explosive powder 14 is detonated using a detonating signal provided by a detonating cord 16. A booster explosive (not shown) may be used between detonating cord 16 and high explosive powder 14 to efficiently transfer the detonating signal from detonating cord 16 to high explosive powder 14.

A liner 18 is also disposed within housing 12 such that high explosive 14 substantially fills the volume between housing 12 and liner 18. Liner 18 of the present invention is formed by pressing, under very high pressure, powdered metal mixture. Following the pressing process, liner 18 becomes a generally conically shaped rigid body that behaves substantially as a solid mass.

In operation, when high explosive powder 14 is detonated using detonating cord 16, the force of the detonation collapses liner 18 causing liner 18 to be ejected from housing 12 in the form of a jet traveling at very high velocity toward, for example, a well casing. The jet penetrates the well casing, the cement and the formation, thereby forming a perforation.

Figure 2:
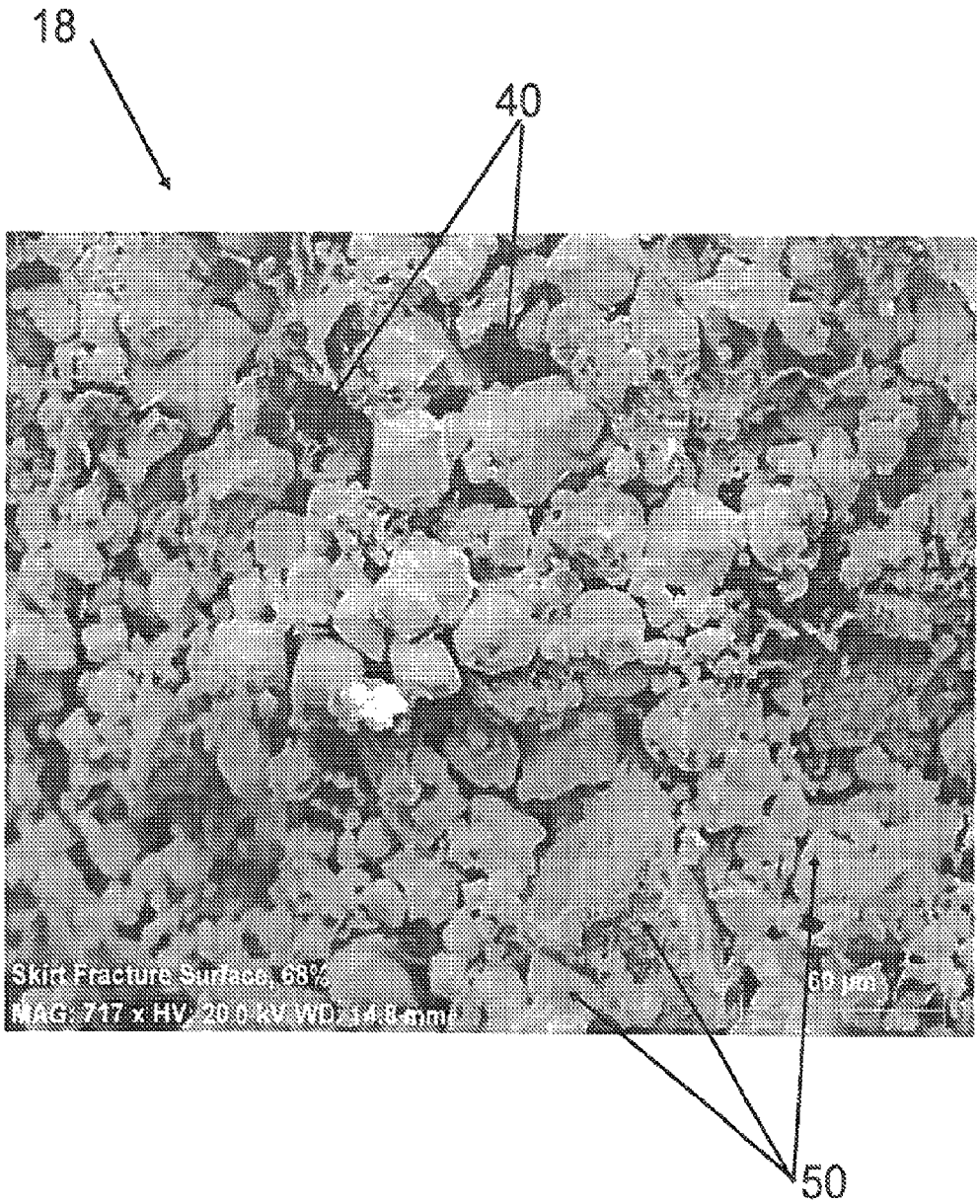
FIG. 2 PRIOR ART
FIG. 2 is an enlarged photograph of a cross section of conventional liner material.

FIG. 2 depicts an enlarged view of a portion of a conventional liner 18 formed by a compressive formation methods using powdered metal constituents (e.g., dry compression forming). In FIG. 2, the constituent materials are tungsten, copper, lead and graphite. Voids 40 of various sizes are evident, between the bulk material particles, which decrease the density of the liner and adversely reduce the potential penetration depth of the shaped charge.

In theory, liner 18 could be made completely from tungsten. Manufacturing difficulties, however, prevent this from being practical because tungsten particles are so hard they do not readily deform, particle-against-particle, to produce a liner with structural integrity. In other words, a liner made completely from tungsten crumbles easily and is too fragile for use in shaped-charge 10. Attempts have been made to strengthen such liners by adding a malleable material such as lead or tin as a binder. These materials have low densities as compared to tungsten. Thus, the resulting penetration depth of a liner made from a combination of tungsten and either a lead or tin binder is not optimum.

Figure 3:
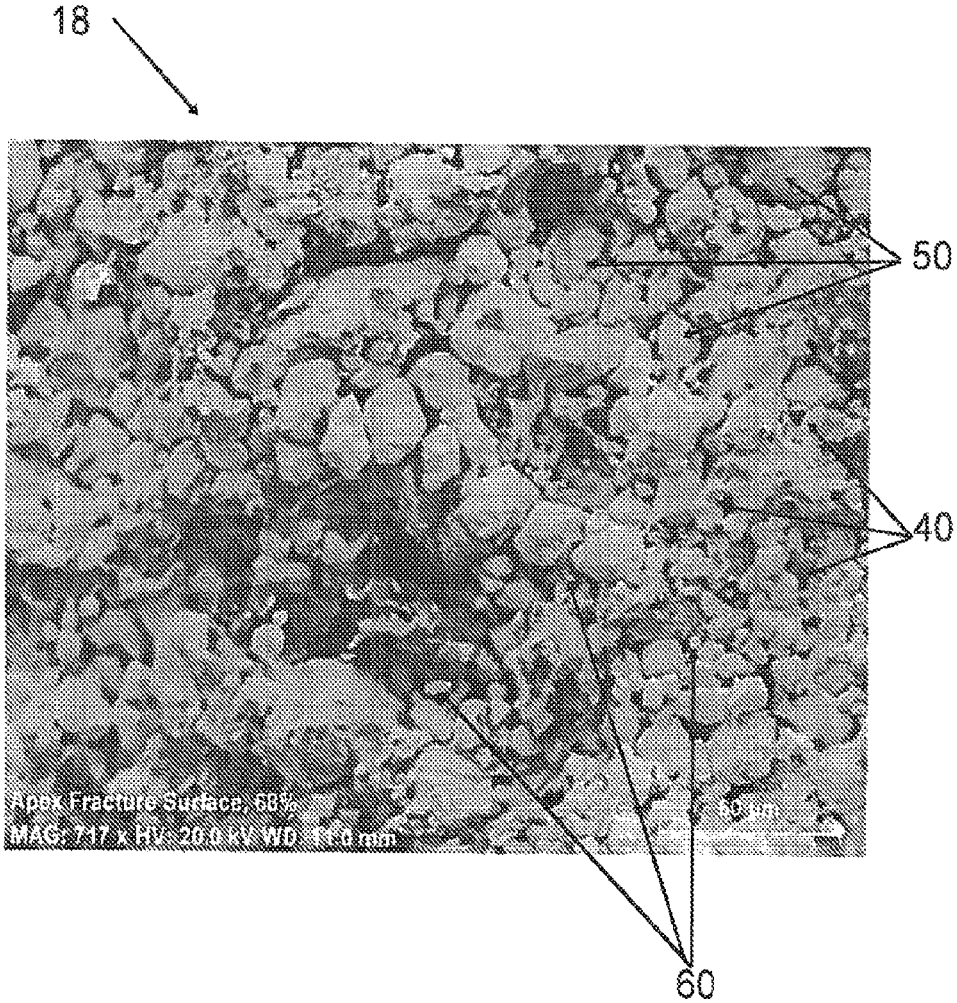
FIG. 3 is an enlarged photograph of a cross section of liner material according to the present invention.

FIG. 3 illustrates an enlarged view of a portion of a liner 18 according to the present invention. Liner 18 of the present invention utilizes nano-sized particles 60 to fit in between the bulk material particles 50 to increase the liner density. As is illustrated in FIG. 3, the voids 40 (or void space) in the material are reduced.

In a preferred embodiment, the powdered metal mixture is used to compressively form a rigid liner body (i.e., dry compression forming the mixture into a rigid body liner), wherein the powdered metal mixture comprises powdered metal, powdered binder materials, and a selected quantity of nanoparticle material. One having ordinary skill in the art will app reciat that because dry ion forming is used the mixture is necessarily dry mixed before dry compression is applied to form the rigid body liner. In an example, the powdered metal can comprise tungsten, copper, or a combination thereof. Other materials known in the art or which become known in the art can be used.

The powdered metal binder can comprise tantalum, molybdenum, lead, copper, or any combination thereof. Other binder materials which are known or become known in the art can be used.

Metal nanoparticles which can be used to increase the density or weight of a liner include tungsten, copper, tantalum, bismuth, lead, nickel, and any combination thereof. Reactive nanoparticles which can be employed in the liner include aluminum, zinc, magnesium, zirconium, titanium, and any combination thereof. The nanoparticle material used in the liner can be a single constituent (e.g., lead) or a mixture of constituents (e.g., lead, zinc and tungsten), where the constituents are nanoparticles.

In particular embodiments of the mixtures, the powdered metal (e.g., tungsten) is in the range of approximately 50to 98 percent by weight; the powdered metal binder is in the range of approximately 1 to 49 percent by weight; and the nanoparticle material is in the range of 1-49 percent by weight. The mixture may additionally include a lubricant, typically graphite and/or oil, which can also act to decrease oxidation of the metals. Using the mixtures of the present invention to compressively form a shaped charge liner, the expected penetration depth of shaped charge is improved over penetration depths achieved by similarly sized shaped charges having liners of compositions known in the art.

Methods of use for the inventions disclosed herein can vary according to the methods known to those of skill in the art. In particular, according to methods disclosed herein, such liners can be used as follows. A method for forming a liner for use in a shaped-charge comprising: mixing powdered metal, powdered metal binder, and a selected amount of nanoparticle material to create a mixture; and compressively forming the mixture into a substantially conical rigid body. This method can additionally include any combination, in any order, of the following steps and/or conditions, namely: wherein the nanoparticle material is metal; wherein the nanoparticle material is selected from the group consisting of copper, tantalum, bismuth, lead, nickel, and any combination thereof; wherein the nanoparticle material is a mixture of nanoparticle constituents; wherein the mixture includes approximately 50-98 percent by weight of powdered tungsten, 1-49 percent by weight of powdered metal binder, 1-49 percent by weight of nanoparticle material; wherein the powdered binder metal is selected from the group consisting of lead, molybdenum, tantalum, copper, aluminum, and any combination thereof; wherein the nanoparticle material is selected from a group of reactive materials consisting of aluminum, zinc, niobium, magnesium, zirconium, titanium, and any combination thereof; and wherein the mixture further comprises a lubricant.

Further methods include a method of penetrating a subterranean formation from a wellbore extending therethrough, the method comprising the steps of: positioning a plurality of shaped charges in the wellbore, each of the shaped charges having a housing, a quantity of high-explosive positioned in the housing, and a liner positioned in the housing such that the quantity of high explosive is positioned between the housing and the liner, and wherein the liner is a rigid body made from a mixture of powdered metal, powdered metal binder, and a selected amount of nanoparticle material; detonating the quantity of high explosive positioned in each shaped charge; ejecting from each shaped charge at high velocity a jet made essentially of the liner; and penetrating the formation, creating perforations extending into the formation. In such methods, the nanoparticle material can be a mixture of two or more nanoparticle constituents, can be metal, and can be selected from the group consisting of tungsten, copper, tantalum, bismuth, lead, nickel, and any combination thereof. Further, the method can be used wherein the mixture includes approximately 50-98 percent by weight of powdered tungsten, 1-49 percent by weight of powdered metal binder, and 1-49 percent by weight of nanoparticle material. Further, such methods can include any one or more of the following conditions or steps, in any order: wherein the powdered binder metal is selected from the group consisting of lead, molybdenum, tantalum, copper, aluminum, and any combination thereof; wherein the nanoparticle material is selected from a group of reactive nanoparticle materials consisting of aluminum, niobium, zinc, magnesium, zirconium, titanium, and any combination thereof; wherein the mixture further comprises a lubricant; the step of positioning a quantity of the reactive nanoparticle material in the perforations; the step of reacting the reactive nanoparticle materials in the perforation with in situ fluid. The reactive nanoparticle materials are jetted or otherwise moved into the formation, more specifically in or along the penetrations extending through the formation. The reactive nanoparticles then react when in the presence of a corresponding reactive fluid or material. In a preferred embodiment, the corresponding reactive fluid is a fluid in situ in the formation. Alternately, a corresponding reactive fluid can be introduced by injection, pumping, etc., before, during or after penetration. The corresponding fluid(s) can be hydrocarbons, brine, water, etc.

While this invention has been described with a reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

The invention claimed is:

1. A method for forming a liner for use in a shaped-charge comprising:

dry mixing a powdered metal, a powdered metal binder, and a nanoparticle material to produce a powdered metal mixture; and dry compression forming the powdered metal mixture into a rigid body liner, wherein the nanoparticle material increases a density of the liner.

2. The method of claim 1, wherein the nanoparticle material is a mixture of nanoparticle constituents.

3. The method of claim 1, wherein the nanoparticle material is selected from the group consisting of tungsten, copper, tantalum, bismuth, lead, nickel, and any combination thereof.

4. The method of claim 1, wherein the powdered metal mixture includes approximately:

50-98 percent by weight of powdered tungsten;

1-49 percent by weight of powdered metal binder; and 1-49 percent by weight of nanoparticle material.

5. The method of claim 1, wherein the powdered metal binder is selected from the group consisting of lead, molybdenum, tantalum, copper, aluminum, and any combination thereof.

6. The method of claim 1, wherein the nanoparticle material is selected from the group consisting of aluminum, zinc, niobium, magnesium, zirconium, titanium, and any combination thereof.

7. A method of penetrating a subterranean formation from a wellbore extending therethrough, the method comprising:

positioning a shaped charge in the wellbore, the shaped charge comprising:

a housing;

a high explosive material positioned in the housing; and a liner positioned in the housing such that the high explosive material is positioned between the housing and the liner, and wherein the liner comprises a rigid body formed by dry compression of a dry powdered metal mixture of a powdered metal, a powdered metal binder, and a nanoparticle material, wherein the nanoparticle material increases a density of the liner; and detonating the shaped charge to eject a jet made of the liner at high velocity to penetrate the formation and create a perforation extending into the formation.

8. The method of claim 7, wherein the nanoparticle material is a mixture of nanoparticle constituents.

9. The method of claim 7, wherein the nanoparticle material is selected from the group consisting of tungsten, copper, tantalum, bismuth, lead, nickel, and any combination thereof.

10. The method of claim 7, wherein the dry powdered metal mixture includes approximately:

50-98 percent by weight of powdered tungsten;

1-49 percent by weight of powdered metal binder;

1-49 percent by weight of nanoparticle material.

11. The method of claim 7, wherein the powdered metal binder is selected from the group consisting of lead, molybdenum, tantalum, copper, aluminum, and any combination thereof.

12. The method of claim 7, wherein the nanoparticle material is selected from the group consisting of aluminum, zinc, niobium, magnesium, zirconium, titanium, and any combination thereof.

13. The method of claim 7, wherein the nanoparticle material is a reactive nanoparticle material and the method further comprises positioning a quantity of the reactive nanoparticle material in the perforation and reacting the reactive nanoparticle material in the perforation with in situ fluid.

14. A liner for a shaped charge comprising a conical rigid body formed by dry compression of a dry powdered metal mixture of a powdered metal, a powdered metal binder, and a nanoparticle material, wherein the nanoparticle material increases a density of the liner.

15. The liner of claim 14, wherein the nanoparticle material is a mixture of nanoparticle constituents.

16. The liner of claim 14, wherein the nanoparticle material is selected from the group consisting of tungsten, copper, tantalum, bismuth, lead, nickel, and any combination thereof.

17. The liner of claim 14, wherein the dry powdered metal mixture includes approximately:

50-98 percent by weight of powdered tungsten;

1-49 percent by weight of powdered metal binder; and 1-49 percent by weight of nanoparticle material.

18. The liner of claim 14, wherein the powdered metal binder is selected from the group consisting of lead, molybdenum, tantalum, copper, aluminum, and any combination thereof.

19. The liner of claim 14, wherein the nanoparticle material is selected from the group consisting of aluminum, zinc, niobium, magnesium, zirconium, titanium, and any combination thereof.

20. A shaped charge comprising:

a housing;

a high explosive material positioned in the housing;

a liner positioned in the housing such that the high explosive material is positioned between the housing and the liner, and wherein the liner comprises a rigid body formed by dry compression of a dry powdered metal mixture of a powdered metal, a powdered metal binder, and a nanoparticle material, wherein the nanoparticle material increases a density of the liner.

21. The shaped charge of claim 20, wherein the nanoparticle material is a mixture of nanoparticle constituents.

22. The shaped charge of claim 20, wherein the nanoparticle material is selected from the group consisting of tungsten, copper, tantalum, bismuth, lead, nickel, and any combination thereof.

23. The shaped charge of claim 20, wherein the powdered metal mixture includes approximately:

50-98 percent by weight of powdered tungsten;

1-49 percent by weight of powdered metal binder; and 1-49 percent by weight of nanoparticle material.

24. The shaped-charge of claim 20, wherein the powdered metal binder is selected from the group consisting of lead, molybdenum, tantalum, copper, aluminum, and any combination thereof.

25. The shaped-charge of claim 20, wherein the nanoparticle material is selected from the group consisting of aluminum, zinc, niobium, magnesium, zirconium, titanium, and any combination thereof.

* * * * *